US009821899B2

(12) United States Patent
Stanley

(10) Patent No.: US 9,821,899 B2
(45) **Date of Patent: *Nov. 21, 2017**

(54) BOAT MOTOR FLUSHING SYSTEM

(71) Applicant: David Stanley, Polk City, FL (US)

(72) Inventor: David Stanley, Polk City, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/149,086

(22) Filed: May 7, 2016

(65) Prior Publication Data

US 2016/0251068 A1 Sep. 1, 2016

Related U.S. Application Data

(63) Continuation-in-part of application No. 14/484,396, filed on Sep. 12, 2014, now Pat. No. 9,359,932.

(51) Int. Cl.

| | |
|---|---|
| ***B63B 13/00*** | (2006.01) |
| ***F01P 3/20*** | (2006.01) |
| ***F02B 61/04*** | (2006.01) |
| ***B63H 20/00*** | (2006.01) |

(52) U.S. Cl.

CPC ..... *B63H 20/001* (2013.01); *B63B 13/00* (2013.01); *F01P 3/205* (2013.01)

(58) Field of Classification Search

CPC ..... F01P 3/205; F01P 2011/065; B63B 13/00; B63H 21/38; B63H 20/28

USPC ..... 440/88 N; 134/167 R

See application file for complete search history.

(56) References Cited

U.S. PATENT DOCUMENTS

| | | | | | |
|---|---|---|---|---|---|
| 3,931,828 | A * | 1/1976 | Lawler | B08B 11/02 | 134/167 R |
| 4,052,953 | A * | 10/1977 | Patel | F01P 3/205 | 134/167 R |
| 4,246,863 | A * | 1/1981 | Reese | F01P 3/205 | 134/167 R |
| 4,359,063 | A * | 11/1982 | Carlson | F01P 3/205 | 134/167 R |
| 4,589,851 | A * | 5/1986 | Karls | B63H 20/36 | 134/167 R |
| 5,051,104 | A * | 9/1991 | Guhlin | F01P 3/205 | 134/167 R |
| 5,397,256 | A * | 3/1995 | Bidwell | F01P 3/205 | 134/167 R |
| 5,423,703 | A * | 6/1995 | Lorenzen | F01P 3/205 | 440/113 |
| 6,314,973 | B1 * | 11/2001 | Vellines | F01P 3/205 | 134/167 R |
| 6,830,493 | B2 * | 12/2004 | Koob | F01P 3/205 | 440/88 N |
| 7,625,256 | B2 * | 12/2009 | Bertino | F01P 3/205 | 440/88 N |
| 7,997,946 | B2 * | 8/2011 | Sirmans | F01P 11/0276 | 134/167 R |

* cited by examiner

*Primary Examiner* — Daniel V Venne
(74) *Attorney, Agent, or Firm* — Sandra L. Layer

(57) ABSTRACT

A flushing system for boat motors that allows for single-handed manipulation to remotely position flushing ears onto the intake vents of an outboard boat motor. A water passage tube provides a source of fresh water when flushing or performing maintenance on the motor of a boat stored on a lift. The flushing ears are positioned on the intake valves and are adjusted to form a seal by a gripping handle. A locking device prevents movement of the ears while flushing the motor and can be released to remove the ears once the flushing is complete.

5 Claims, 4 Drawing Sheets

FIG. 1
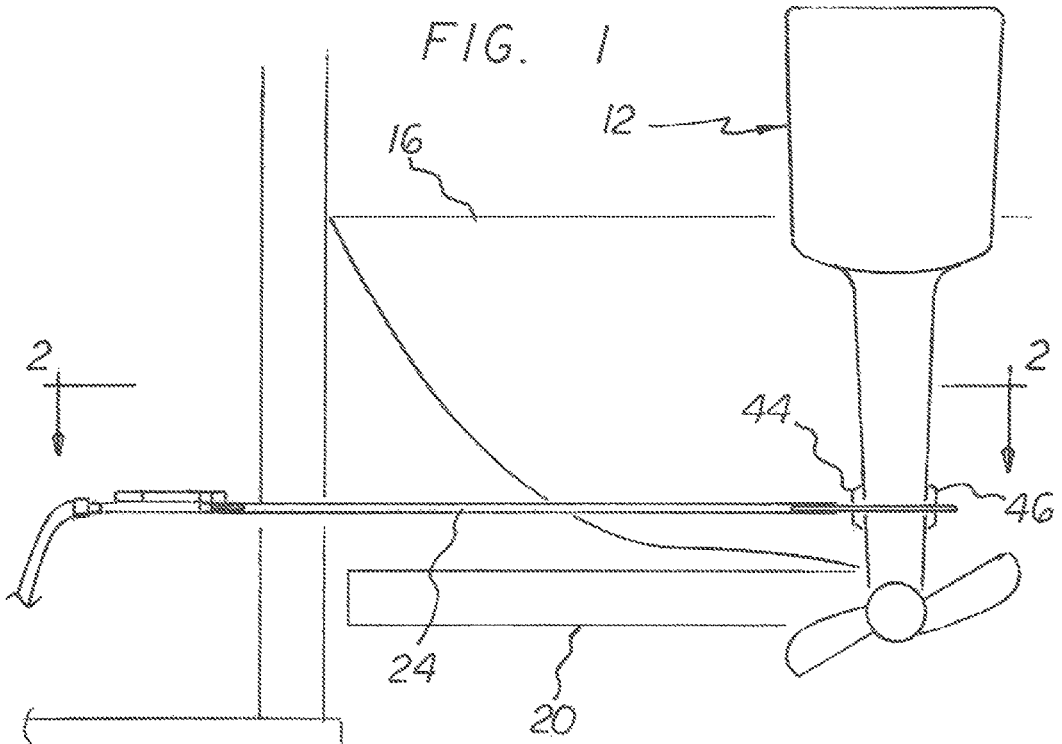
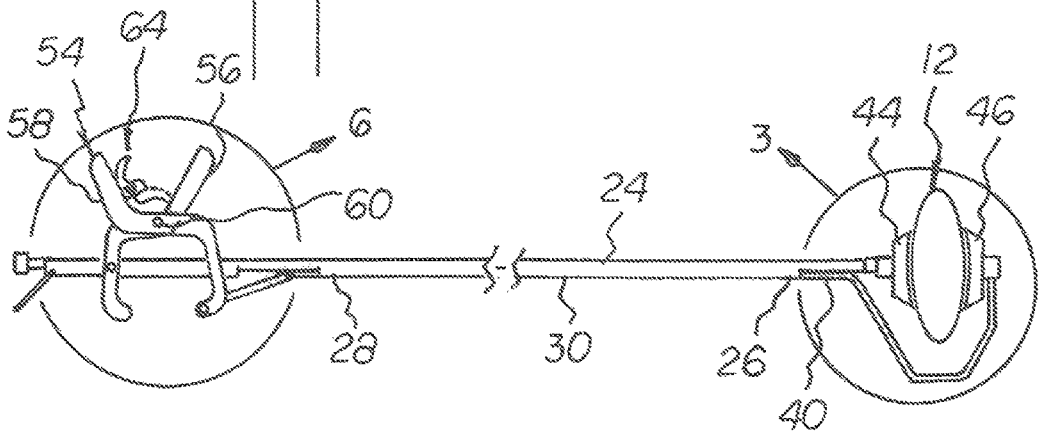
FIG. 2

FIG. 3
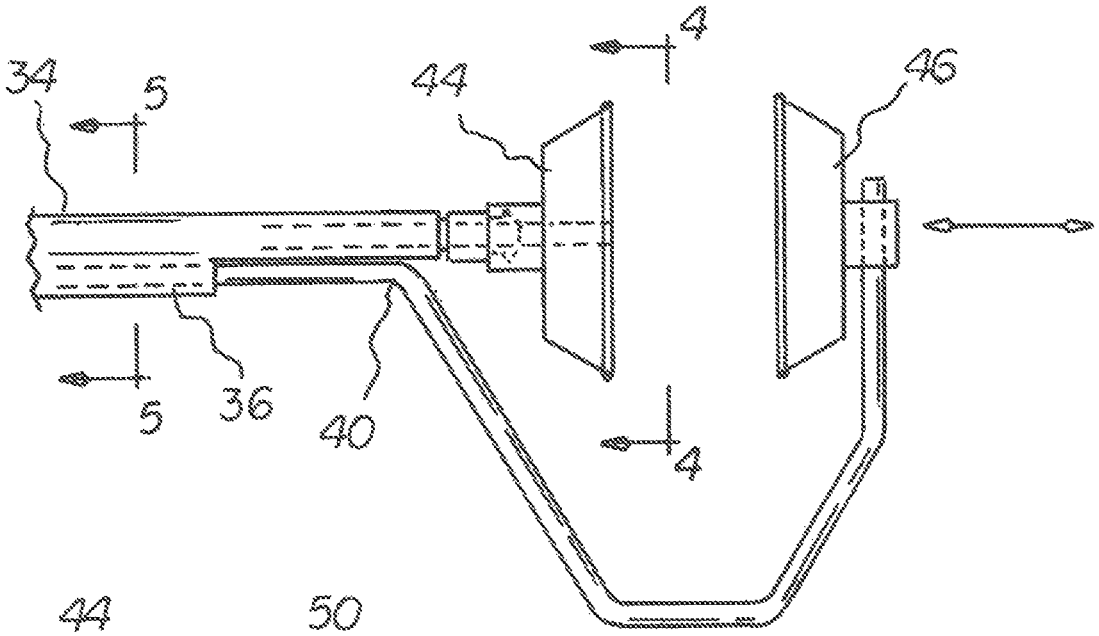
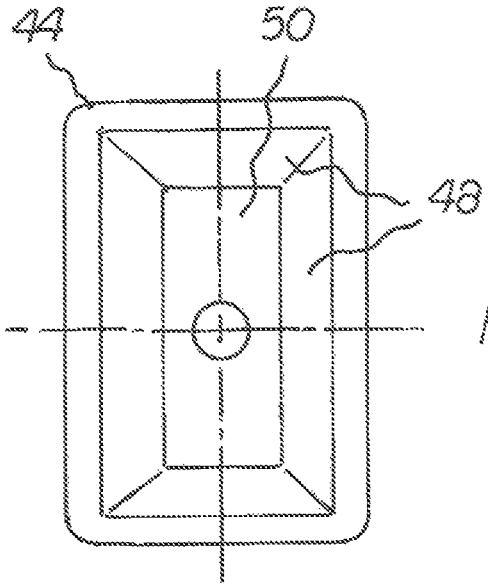
FIG. 4
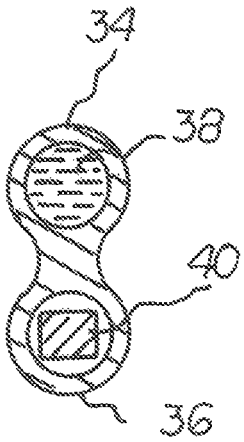
FIG. 5

FIG. 8
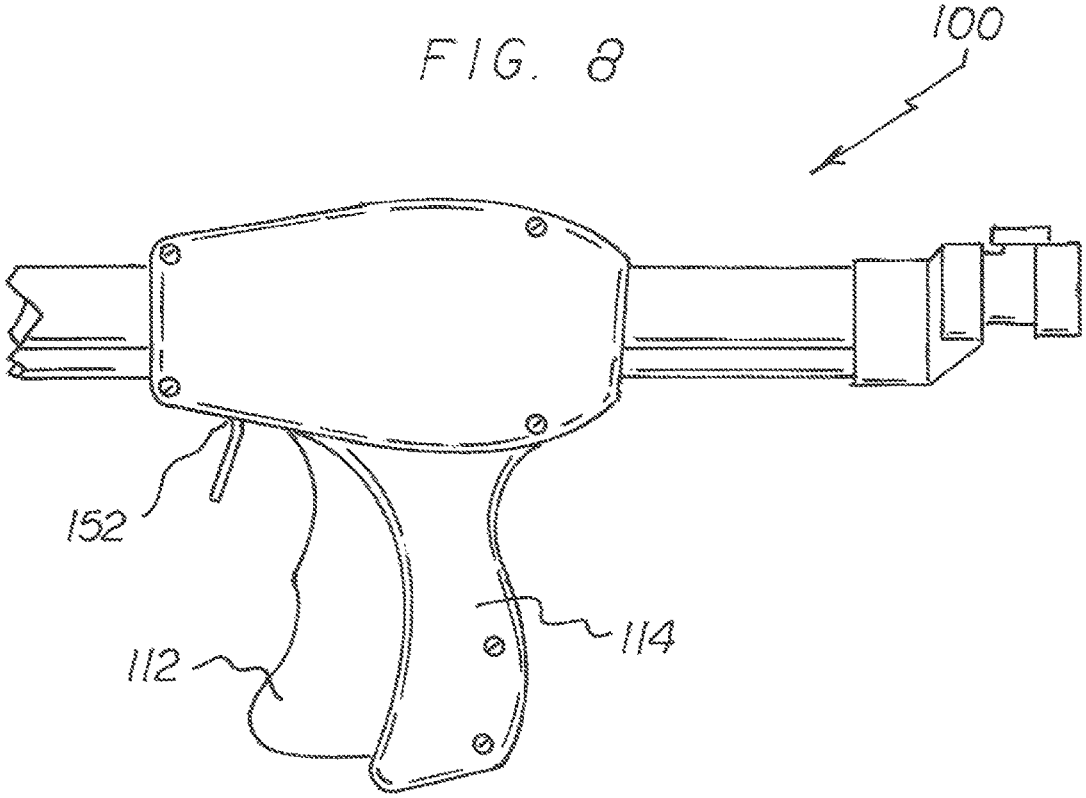
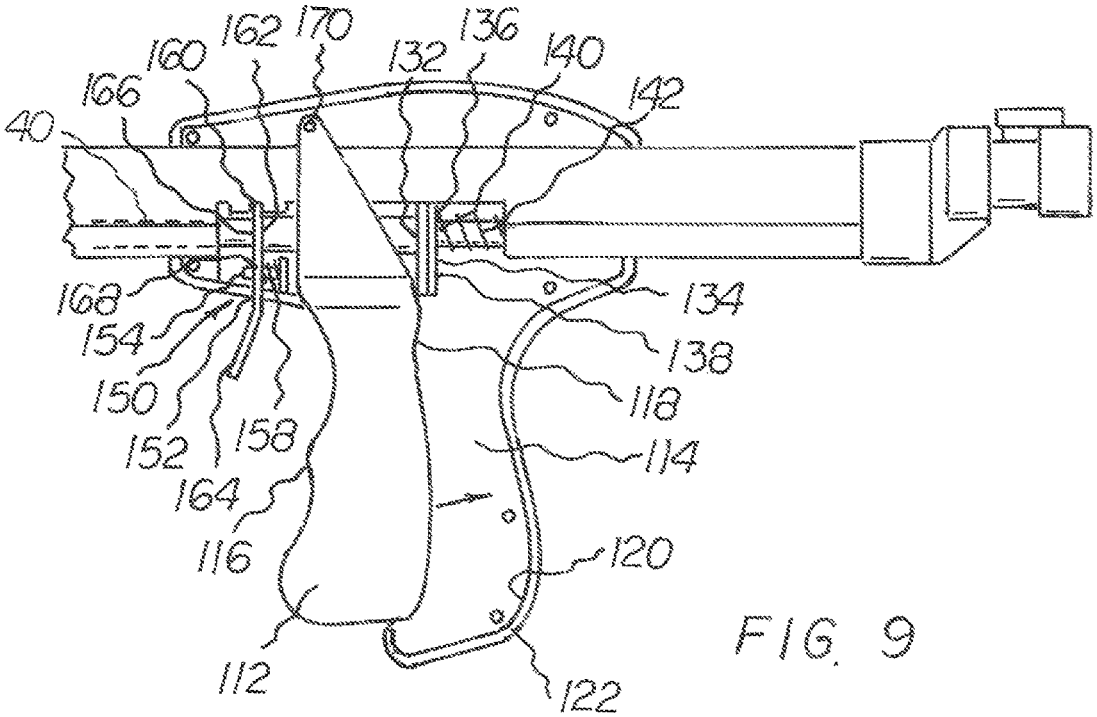
FIG. 9

BOAT MOTOR FLUSHING SYSTEM

RELATED APPLICATION

The present application is a continuation-in-part of U.S. patent application Ser. No. 14/484,396 filed Sep. 12, 2014, now U.S. Pat. No. 9,359,932 the subject matter of which application is incorporated in its entirety herein by reference.

BACKGROUND OF THE INVENTION

Field of the Invention

The present invention relates to a boat motor flushing system and more particularly pertains to providing a source of fresh water when flushing or performing maintenance on the motor of a boat stored on a lift in a safe, quick, convenient and economical manner.

Description of the Prior Art

The use of flushing systems is known in the prior art. More specifically, flushing systems previously devised and utilized for the purpose of providing a water source for flushing and maintenance are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 5,4234,703 issued Jun. 13, 1995 to Thomas H. Lorenzen discloses an outboard motor flushing system. U.S. Pat. No. 4,246,863 issued Jan. 27, 1981 to John T. Reese discloses a flushing assembly. Lastly, U.S. Pat. No. 7,997,946 issued Aug. 16, 2011 to Dewayne Sirmans discloses a flushing assembly for an outboard motor.

While these devices fulfill their respective, particular objectives and requirements, the aforementioned patents do not describe a boat motor flushing system that allows for single handed manipulation when remotely positioning the flushing ears providing a source of fresh water when flushing or performing maintenance on the motor of a boat stored on a lift. The positioning of the flushing system performed in a safe, quick, convenient and economical manner.

In this respect, the boat motor flushing system according to the present invention substantially departs from the conventional concepts and designs of the prior art, and in doing so provides an apparatus primarily developed for the purpose of providing a source of fresh water when flushing or performing maintenance on the motor of a boat stored on a lift in a safe, quick, convenient and economical manner.

The present invention is safe and easy to use compared to existing flushing assemblies. The user does not have to lean over the water or perch precariously on the back of the boat in order to place the flushing ears over the intake vents on the outboard motor. Nor does the user have to apply force to properly position and seal the ears over the intake vents. The gripping handle and simple design allow for single handled operation. The locking mechanism keeps the ears tight during the flushing operation protecting the engine from damage. It has been shown that properly maintaining the engine by flushing with fresh clean water will extend the life of the motor and having a safe easy system to use for completing the flushing may result in boat operators flushing more often.

Therefore, it can be appreciated that there exists a continuing need for a new and improved boat motor flushing system which can be used for providing a source of fresh water when flushing or performing maintenance on the motor of a boat stored on a lift in a safe, convenient and economical manner. In this regard, the present invention substantially fulfills this need by providing a system which can be easily manipulated, allowing for remote placement of the flushing ears without the use of force and a locking gripping mechanism to maintain the seal provided by the flushing ears over the water intake ports during the flushing operation.

SUMMARY OF THE INVENTION

In view of the foregoing disadvantages inherent in the known types of boat motor flushing systems now present in the prior art, the present invention provides an improved boat motor flushing system. As such, the general purpose of the present invention, which will be described subsequently in greater detail, is to provide a new and improved boat motor flushing system and method which has all the advantages of the prior art and none of the disadvantages. To attain this, the present invention essentially comprises boat motor flushing system formed with a long double tube with a gripping handle having a locking mechanism and a set of remotely manipulatable ears. First provided is a double tube formed with a first tube used for the passage of water and a second tube configured as passage for a locking rod axially reciprocable for the application and release of coupling forces. A set of flushing ears are attached to the distal end of the tube. One ear is secured to the distal end of the first tube allowing for the passage of water through the ear. The second ear is secured to the distal end of the locking rod on the outside of the second ear. The proximal end of the double tube has a handle formed with a gripping component adapted to be gripped by a user and squeezed to move the locking rod proximally and shift the ears toward each other for securement to the intake vents of a motor to be flushed. A locking assembly operates in conjunction with the gripping handle to lock the rod in place keeping the ears locked in sealing contact with the intake vents of the motor. A fitting is located at the proximal end of the flushing tube for coupling to a source of cleaning water for movement through the upper tube.

A feature of the invention includes the fitting being formed with a valve to initiate and terminate the flow of water through the flushing tube.

Another feature of the invention is a ring attached to the proximal end for storage and transportation.

Still another feature of the invention is a floatation device attached to the flushing system to provide buoyancy in the event the system is dropped into the water.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved boat motor flushing system which has all of the advantages of the prior art boat motor flushing systems and none of the disadvantages.

It is another object of the present invention to provide a new and improved boat motor flushing system which may be easily and efficiently manufactured and marketed.

It is further object of the present invention to provide a new and improved boat motor flushing system which is of durable and reliable constructions.

An even further object of the present invention is to provide a new and improved boat motor flushing system which is susceptible of a low cost of manufacture with regard to both materials and labor, and which accordingly is then susceptible of low prices of sale to the consuming public, thereby making such boat motor flushing system economically available to the buying public.

Still another object of the present invention is to provide safe method to attach the flushing ears to an outboard motor while the boat is on a raised lift from a remote distance such as a dock or the shore.

Even still another object of the present invention is to provide a boat motor flushing system for providing a source of fresh water when flushing or performing maintenance on the motor of a boat stored on a lift which can be easily manipulated, allowing for remote placement of the flushing ears without the use of force.

Lastly, it is an object of the present invention to provide a new and improved boat motor flushing system providing a system which includes a locking gripping mechanism to maintain the seal provided by the flushing ears over the water intake ports during the flushing operation.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a side elevational view of a boat motor cleaning system constructed in accordance with the principles of the present invention.

FIG. 2 is a plan view taken along line 2-2 of FIG. 1.

FIG. 3 is an enlarged showing of a portion of the system taken at circle 3 of FIG. 2.

FIG. 4 is a side elevational view of a portion of the system taken along line 4-4 of FIG. 3.

FIG. 5 is a cross sectional view taken along line 4-4 of FIG. 3.

FIG. 8 is a side view of a handle for a boat motor cleaning system constructed in accordance with an alternate embodiment of a present invention.

FIG. 9 is a cross sectional view of a handle for a boat motor cleaning system constructed in accordance with an alternate embodiment of the present invention.

The same reference numerals refer to the same parts throughout the various Figures.

DESCRIPTION OF THE PREFERRED EMBODIMENT

Figure 6:
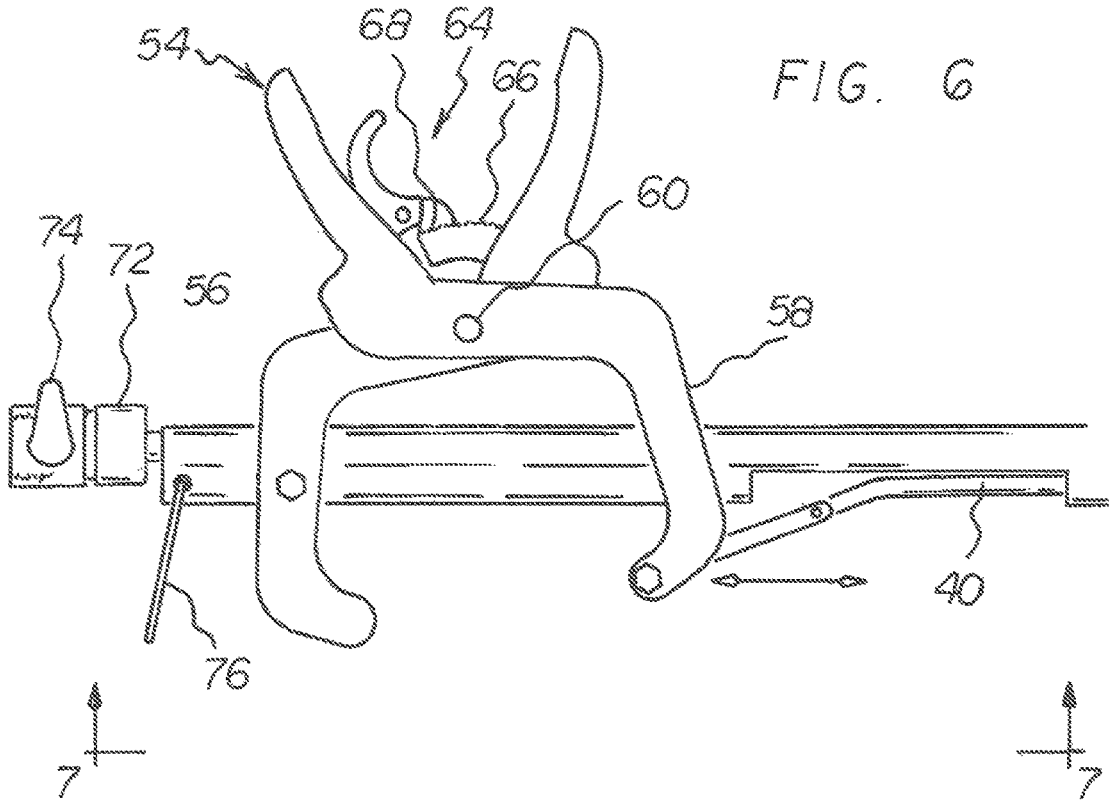
FIG. 6 is an enlarged showing of a portion of the system taken at circle 6 of FIG. 2.
Figure 7:
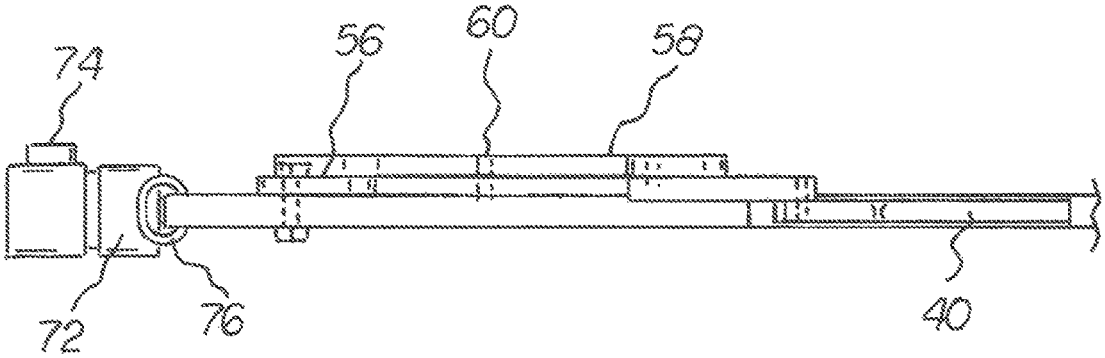
FIG. 7 is a plan view taken along line 7-7 of FIG. 6.

With reference now to the drawings, and in particular to FIG. 1 thereof, the preferred embodiment of the new and improved Boat Motor flushing system embodying the principles and concepts of the present invention and generally designated by the reference numeral 10 will be described.

The present invention, the boat motor flushing system 10 is comprised of a plurality of components. Such components in their broadest context include a water passage tube, a locking rod, flushing ears, gripping handle and locking assembly. Such components are individually configured and correlated with respect to each other so as to attain the desired objective.

In the broadest sense the system is comprised of a double tube formed with a distal end and a proximal end and having a central extent. The central extent having an 8-shaped configuration with a first tube used for the passage of water and a second tube configured as a locking rod axially reciprocable for the application and release of coupling forces. A set of interior and exterior ears is attached to the distal end of the tube. Each ear having walls and a floor and an open face. The floor of the interior ear is secured to the distal end of the cleaning double tube. The floor of the exterior ear is secured to the distal end of the locking rod distally of the interior ear. The proximal end has a handle formed with a first component and a second component adapted to be gripped by a user and squeezed to move the locking rod proximally and shift the ears toward each other for securement to a motor to be flushed. A fitting is located at the proximal end of the first tube for coupling to a source of cleaning water for movement through the upper tube.

In the preferred embodiment of a boat motor flushing system first provided is a cleaning double tube 24 horizontally oriented and formed of a distal end 26 and a proximal end 28 with a central extent 30 between the proximal end and distal end. The central extent has an 8-shaped configuration with an upper tube 34 and a lower tube 36. The upper tube is hollow for the movement of cleaning water 38 from the proximal end to the distal end. The lower tube is hollow for passage of a locking rod 40 axially reciprocable for the application and release of coupling forces between the cleaning double tube and the vertically placed parallel water intake valves of the boat motor.

A pair of flushing ears is located adjacent to the distal end of the double cleaning tube is comprised of an interior ear 44 and an exterior ear 46. Each ear has four trapezoidal walls 48 and a floor 50 and an open rectangular face. The floor of the interior ear is secured to the distal end of the cleaning double tube. The floor of the exterior ear is secured to the distal end of the locking rod distally of the interior ear. The open rectangular faces of the interior and exterior ears are in facing contact with the water intake vents of the boat motor. The locking rod distally of the lower tube is formed in a generally U-shaped configuration extending around the interior and exterior ears.

A handle 54 is located adjacent to the proximal end of the cleaning tube. The handle has a first component 56 and a second component 58, with a pivot pin 60 joining the first and second components centrally. The first component has an outer end and an inner end pivotally coupled to the cleaning double tube adjacent to the proximal end. The second component has an outer end. The second component has an inner end pivotally coupled to the locking rod. The outer ends of the first and second components are adapted to be gripped by a user and squeezed to move the locking rod proximally and shift the ears toward each other for securement to the water intake vents of the boat motor.

A locking assembly 64 having second teeth 66 in an arc is attached to the first component. The locking assembly has first teeth 68 in an arc pivotally attached to the second component whereby movement of the second teeth into contact with the first teeth will lock the ears locked in sealing contact with the water intake vents of the boat motor.

A fitting 72 is provided at the proximal end of the cleaning double tube for coupling to a source of cleaning water for movement through the upper tube and inner ear. The fitting has a valve 74 to initiate and terminate the flow of water through the cleaning double tube. A D-ring 76 is attached to the cleaning double tube adjacent to the proximal end for storage and transportation.

In the preferred embodiment, the ears are fabricated of an elastomeric material such as plastic or rubber, natural or synthetic and blends thereof. The other components are fabricated of rigid materials such as metal, plastic or composite materials.

In a preferred alternate embodiment shown in FIGS. 8 and 9, the handle 100 is adapted to be gripped by a user and squeezed to move the locking rod proximally using a ratcheting motion to shift the ears toward each other for securement to a motor to be flushed. The handle 100 in the broadest sense comprises a cover, a trigger, a push plate and a locking assembly. The handle is comprised of a first component 112 and a second component 114 adapted to be gripped by a user and squeezed. The first component 112 is a trigger having forward face 116 and a rearward face 118. The second component is formed as a cover having an interior surface 120 and an exterior surface 122.

A pivot pin 170 joins the trigger and the cover above the locking rod 40.

A push plate 130 having a forward face 132, a rearward face 134, an upper portion 136 and a lower portion 138. A first aperture 140 is located in the upper portion of the plate. The locking rod passes through the first aperture. A first resilient member 142 encircles the locking rod adjacent to the rearward face of the push plate and urges the plate forward.

When the handle is gripped and the trigger squeezed, the rearward face of the trigger slidably presses against the lower portion of the forward face of the push plate urging the lower portion of the push plate rearward and engaging the locking rod. As the trigger continues to be squeezed, the push plate pulls the locking rod axially rearward, shifting the exterior ear toward the interior ear for securement to the water intake vents of the boat motor to be flushed.

A locking assembly 150 comprises a retaining tab 152, a post 154, a second resilient member 158 and a notch 160. The post is positioned below and parallel to the locking rod and projects from a vertical plate 156 formed on the interior surface of the cover. The second resilient member 158 encircles the post. The notch 160 is formed in the cleaning double tube above the retaining tab. The retaining tab has an upper retaining end 162, a central section and a lower release end 164. The upper retaining end extends into the notch. The locking rod passes through a second aperture 166 formed in the upper retaining end. The second aperture is adapted to releasably engage the locking rod when retaining tab is in the locked position to prevent forward movement of the locking rod. The post passes through a hole 168 formed in the central section of the retaining tab. The second resilient member pivots the lower release end forward forcing the upper retaining end into the locked position with respect to forward motion. When the lower release end is moved rearward, the upper retaining end disengages the locking rod, compressing the resilient member and pivoting the upper retaining end to a vertical and unlocked position.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A boat motor flushing system comprising:

a cleaning double tube formed of a distal end and a proximal end with a central extent between the proximal end and the distal end;

the central extent having an 8-shaped configuration with a first tube, a second tube and a locking rod, the first tube being hollow for the for passage of water and the second tube being hollow for passage of the locking rod, the locking rod being axially reciprocable for application and release of coupling forces;

an interior and an exterior ear, the interior ear having walls and a floor and an open face, the exterior ear having walls and a floor and an open face, the floor of the interior ear secured to the distal end of the first tube of the central extent of the cleaning double tube, the interior ear having a port in fluid connection with the hollow interior of the first tube for passage of water, the floor of the exterior ear secured to the distal end of the locking rod distally of the interior ear;

a fitting at the proximal end of the cleaning double tube for coupling to a source of cleaning water for movement through the first tube and the interior ear;

a handle, the handle comprising a cover, a trigger, a push plate, a pivot pin and a locking assembly, the push plate having a forward face, a rearward face, an upper portion and a lower portion, the pivot pin joining the trigger and the cover above the locking rod;

the handle adapted to be gripped by a user and squeezed to move the locking rod proximally using a ratcheting motion, shifting the exterior ear toward the interior ear for securement to a motor to be flushed.

2. The boat motor flushing system as set forth in claim 1 wherein the push plate is further defined as having a first aperture located in the upper portion of the push plate, the locking rod passing through the first aperture.

3. The boat motor flushing system as set forth in claim 2 wherein a first resilient member encircles the locking rod adjacent to the rearward face of the push plate urging the push plate forward.

4. The boat motor flushing system as set forth in claim 1 wherein the locking assembly is further defined as comprising a retaining tab, a post below and parallel to the locking rod, a second resilient member, the second resilient member encircling the post, and a notch formed in the cleaning double tube above the retaining tab, the retaining tab having an upper retaining end, a central section and a lower release end, the upper retaining end extending into the notch, the upper retaining end having a second aperture, the locking rod passing through the second aperture, the second aperture adapted to releasably engage the locking rod when in the locked position to prevent forward movement of the locking rod, a hole formed in the central section of the retaining tab, the post passing through the hole, the second resilient member pivoting the lower release end forward forcing the upper retaining end into the locked position with respect to forward motion, the upper retaining end disengaging the locking rod when the lower release end is moved rearward, compressing the resilient member and pivoting the upper retaining end to a vertical and unlocked position.

5. A boat motor flushing system comprising:

a cleaning double tube formed of a distal end and a proximal end with a central extent between the proximal end and distal end;

the central extent having an 8-shaped configuration with a first tube, a second tube and a locking rod (40), the first tube being hollow for the for passage of water and the second tube being hollow for passage of the locking rod, the locking rod being axially reciprocable for application and release of coupling forces;

an interior and an exterior ear, the interior ear having walls and a floor and an open face, the exterior ear having walls and a floor and an open face, the floor of the interior ear secured to the distal end of the first tube of the central extent of the cleaning double tube, the interior ear having a port in fluid connection with the hollow interior of the first tube for passage of water, the floor of the exterior ear secured to the distal end of the locking rod distally of the interior ear;

a fitting at the proximal end of the cleaning double tube for coupling to a source of cleaning water for movement through the first tube and the interior ear;

a handle having a first component (112) and a second component (114) adapted to be gripped by a user and squeezed to move the locking rod proximally, the first component (112) comprising a trigger having forward face (116) and a rearward face (118), the second component formed as a cover having an interior surface (120) and an exterior surface (122);

a pivot pin (170), the pivot pin joining the trigger and the cover above the locking rod;

a push plate (130), the push plate having a forward face (132), a rearward face (134), an upper portion (136) and a lower portion (138), a first aperture (140) located in the upper portion of the push plate, the locking rod passing through the first aperture, a first resilient member (142) encircling the locking rod adjacent to the rearward face of the push plate and urging the push plate forward;

the rearward face of the trigger adapted to slidably press against the lower portion of the forward face of the push plate when squeezed, the trigger urging the lower portion of the push plate rearward causing the push plate to engage the locking rod, pulling the locking rod axially rearward, shifting the exterior ear toward the interior ear for securement to the water intake vents of the boat motor to be flushed when squeezed by the user; and a locking assembly (150), the locking assembly comprising a retaining tab (152), a post (154) below and parallel to the locking rod and projecting from a vertical plate (156) formed on the interior surface of the cover, a second resilient member (158) encircling the post, and a notch (160) formed in the cleaning double tube above the retaining tab, the retaining tab having an upper retaining end (162), a central section and a lower release end (164), the upper retaining end extending into the notch, a second aperture (166) formed in the upper retaining end, the locking rod passing through the second aperture, the second aperture adapted to releasably engage the locking rod when in the locked position to prevent forward movement of the locking rod, a hole formed in the central section of the retaining tab, the post passing through the hole, the second resilient member pivoting the lower release end forward forcing the upper retaining end into the locked position with respect to forward motion, the upper retaining end disengaging the locking rod when the lower release end is moved rearward, compressing the resilient member and pivoting the upper retaining end to a vertical and unlocked position.

* * * * *